United States Patent [19]

Wildish et al.

[11] Patent Number: 4,905,891

[45] Date of Patent: Mar. 6, 1990

[54] SECURITY MAILBOX

[76] Inventors: Gene E. Wildish; Patricia A. Sicotte, both of P.O. Box 651, Boulder, Mont. 59632

[21] Appl. No.: 236,761

[22] Filed: Aug. 26, 1988

[51] Int. Cl.[4] ..... B65D 91/00

[52] U.S. Cl. ..... 232/17; 232/43.1

[58] Field of Search ..... 232/17, 39, 43.1

[56] References Cited

U.S. PATENT DOCUMENTS

| | | | |
|---|---|---|---|
| 1,480,452 | 1/1921 | Kolstad . | |
| 1,994,186 | 3/1935 | Anderson | 232/39 |
| 2,477,276 | 7/1949 | Walton . | |
| 3,802,619 | 4/1974 | Leigh . | |
| 3,880,344 | 4/1975 | Earle . | |
| 4,509,675 | 4/1985 | Siff . | |
| 4,724,999 | 2/1988 | Fitzgerald et al. | 232/17 |

*Primary Examiner*—Robert W. Gibson, Jr.
*Attorney, Agent, or Firm*—William D. West

[57] ABSTRACT

A security mailbox is provided having a housing with a lower storage compartment having a lockable door for the retraction of mail and an upper door for the introduction of mail. The upper portion of the mailbox is further provided with a sloping slanted top, a tray mounted in the interior for the placement of outgoing mail, a restricted throat with a curved lower portion leading into the storage area for the introduction of mail so that the mail is deposited into the storage department and can only be retrieved through the lower lockable door. A conventional manually rotatable flag is attached on the outside of the mailbox. A method of mounting multiple security mailboxes is also disclosed.

8 Claims, 3 Drawing Sheets

FIG. 3
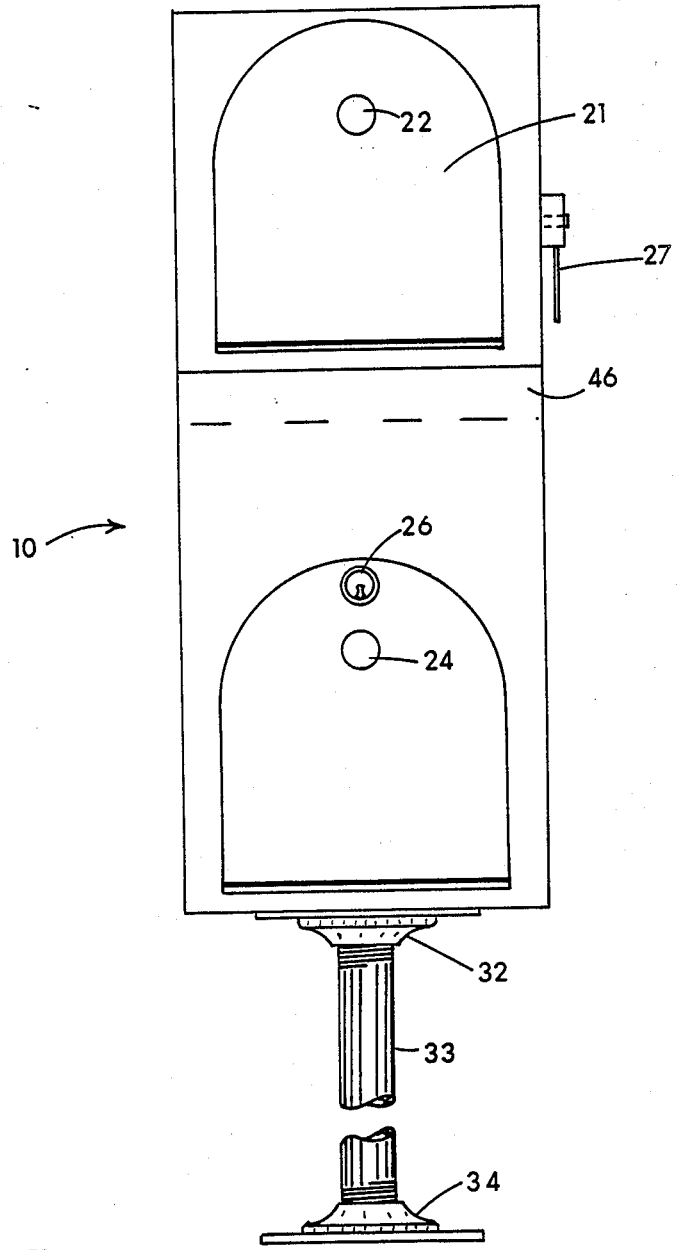
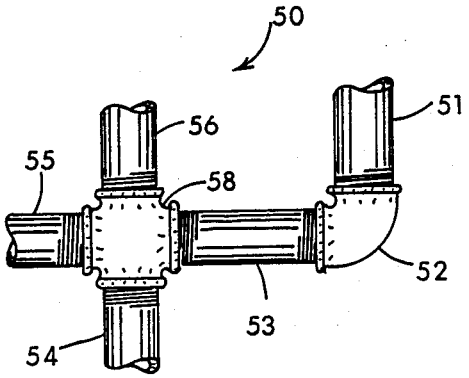
FIG. 4

SECURITY MAILBOX

BACKGROUND OF THE INVENTION

1. Field of the Invention

This invention relates to a mailbox and in particular to a security mailbox having a lockable storage compartment.

2. Discussion of the Technical Problems

Mailbox theft and vandalism is a reoccuring problem. Rural mailboxes often are located at great distances from houses on very lightly traveled roads. In order to be assured that the contents of the mailbox are not removed or destroyed, it is necessary to pick up ones mail immediately after the mailman has deposited it. Unfortunately, daily pickups are not always possible if the postal patron is engaged in ranching or farming. Some persons are not be able to get to the mailbox for several days. Additionally, in the event of a vacation trip away from home, the mail must remain in the mailbox until it is picked up. Conventional mailboxes are constructed without any type of locking device or security system.

While it would seem feasible to install a lock on a conventional mailbox in order to keep the contents secure, such locks necessitate the mailman having a separate key for each postal patron's mailbox. A mailbox locking system is thus not feasible in that it is too complex to have so many keys and the mailman would be slowed in his delivery rounds to an extent that the Postal Service would not allow such a system.

In order to provide the security for first class and other mail some postal patrons have provided mailboxes which have trap doors or the like in conjunction with mail drop chutes to keep the mail from being stolen through the mail drop opening.

Other attempts have been made to provide mailboxes with locking compartments and trap doors, but such arrangements necessitate having moving parts which become jammed and are unlikely to provide years of continuous, trouble free service.

Prior art security mailboxes are generally the type employing trap doors and various rotating interior barriers. The ideal security mailbox on the other hand would provide a secure storage for first class and other mail and yet allow easy opening from a vehicle by the postal patron and not necessitate the mailman using a key or other device while still providing a mailbox without moving parts. While no known examples of such a security mailbox exist, U.S. Pat. No. 3,880,344 to Earle issued Apr. 29, 1975, discloses a security mailbox having a movable, pivoting door located within a mailbox throat. The Earle patent also provides a storage receptacle, and a lockable lower door.

Other mailboxes having various structural arrangements are known. Examples of such mailboxes can be found in U.S. Pat. No. 1,480,452 issued Jan. 8, 1924, to Kolstad, U.S. Pat. No. 2,477,276 issued July 26, 1949, to Walton, and U.S. Pat. No. 4,509,675 issued Apr. 9, 1985, to Siff et al.

Very few devices in the known art relate to lockable, secured mailboxes and none known are directed to providing a security mailbox having a receptacle for outgoing mail and with a restricted mail introduction throat. Accordingly, a need exists for a mailbox that would provide safe, convenient secured mailbox storage and yet would allow the postal patron from a vehicle to remove the mail through a lockable opening. Such a mailbox would provide a simple, inexpensive apparatus that could be adapted to existing mailbox posts and supports or provide single and multiple mountings to support multiple mailboxes. A mailbox of that type would be simple in design, easy to maintain, easily repaired, not subject to damage by proper use, and simple to manufacture. The instant invention is directed to all these needs as well as to others as explained in the following summary.

SUMMARY OF THE INVENTION

It is a feature of the invention to provide a security mailbox.

It is another feature of the invention to provide a security mailbox having a lockable storage compartment.

It is another feature of the invention to provide a security mailbox having a weather-tight door for the introduction of mail and a weather tight lockable door for the retraction of mail. These and other feature and objects are obtained according to the instant invention by providing a security mailbox having a lower storage compartment with a lockable door for the retraction of mail and an upper door for the introduction of mail. The mailbox is provided with a housing having an upper opening and a lower opening on the front portion. The upper portion of the mailbox is further provided with a sloping snow, wind, and rain shedding slanted top, a tray mounted in the interior for the placement of outgoing mail, a restricted throat with a curved lower portion leading into the storage area for the introduction of mail so that the mail is deposited into the storage department and can only be retrieved through the lower lockable door. A conventional manually rotatable flag is attached on the outside of the mailbox.

BRIEF DESCRIPTION OF THE DRAWINGS

The advantages of this invention will become apparent upon consideration of the following detailed disclosure of the invention, especially when taken in conjunction with the accompanying drawings, wherein:

FIG. 3 is a front elevational view of the outside of the security mailbox.

FIG. 4 is a connection of the mailbox support for multiple mailboxes all in accordance with the present invention.

DESCRIPTION OF THE PREFERRED EMBODIMENTS

Figure 1:
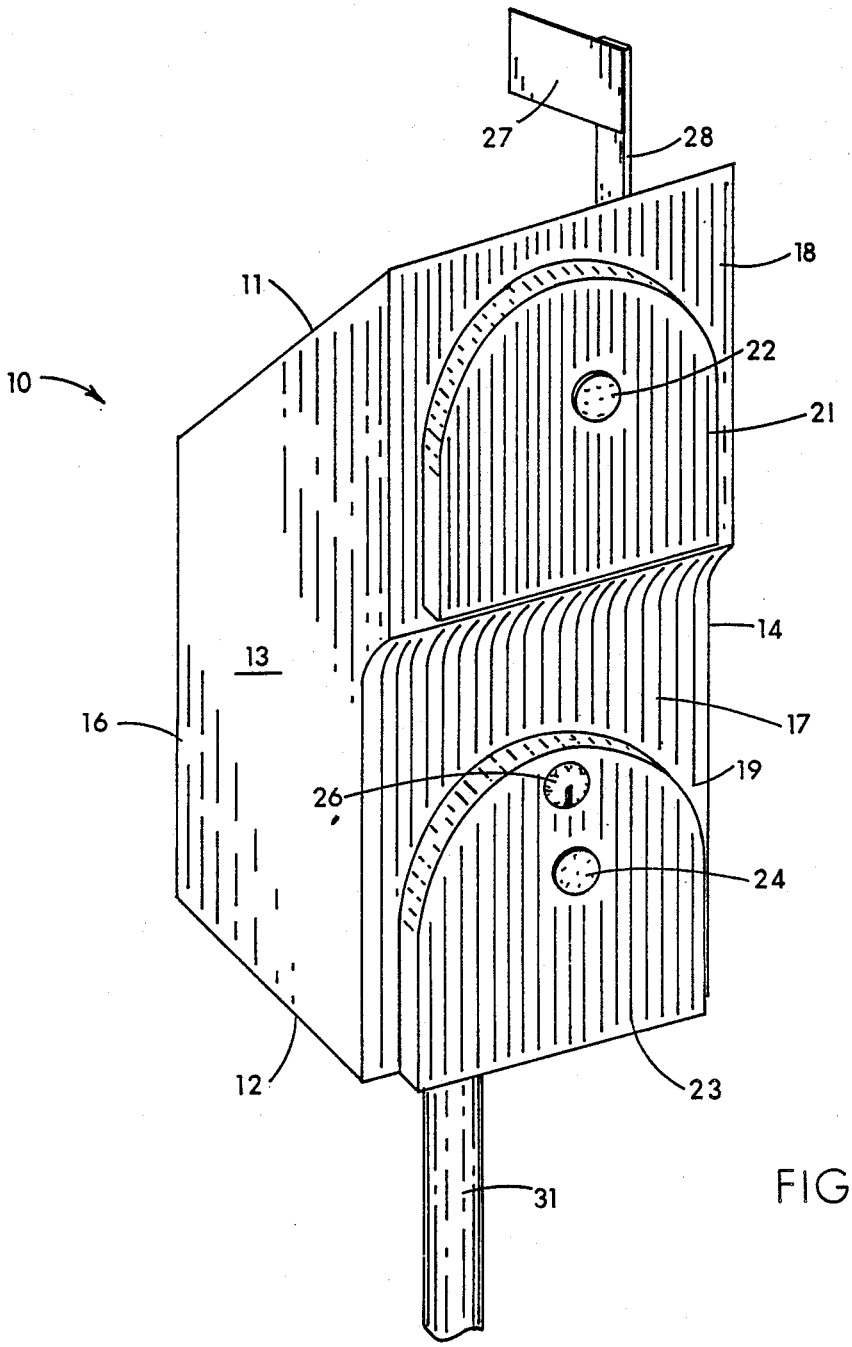
FIG. 1 is a perspective view of the security mailbox in accordance with the present invention.

The security mailbox apparatus is depicted generally in FIG. 1. As can be seen by reference to FIG. 1, the security mailbox 10 is essentially a mail holding box or receptacle having a slanted top 11, a flat horizontal base 12, upstanding sidewalls 13 and 14, back wall 16, and front wall 17. The front wall is further provided with an upper front wall 18 and a lower front wall 19. Upper front wall 18 is provided with a hinged door 21 having a door knob 22. Lower front wall 19 is provided with a hinged door 23 having a door knob 24 and a lock 26. Flag 27 is attached to flag arm 28 in a pivotal manner well known in the art.

Figure 2:
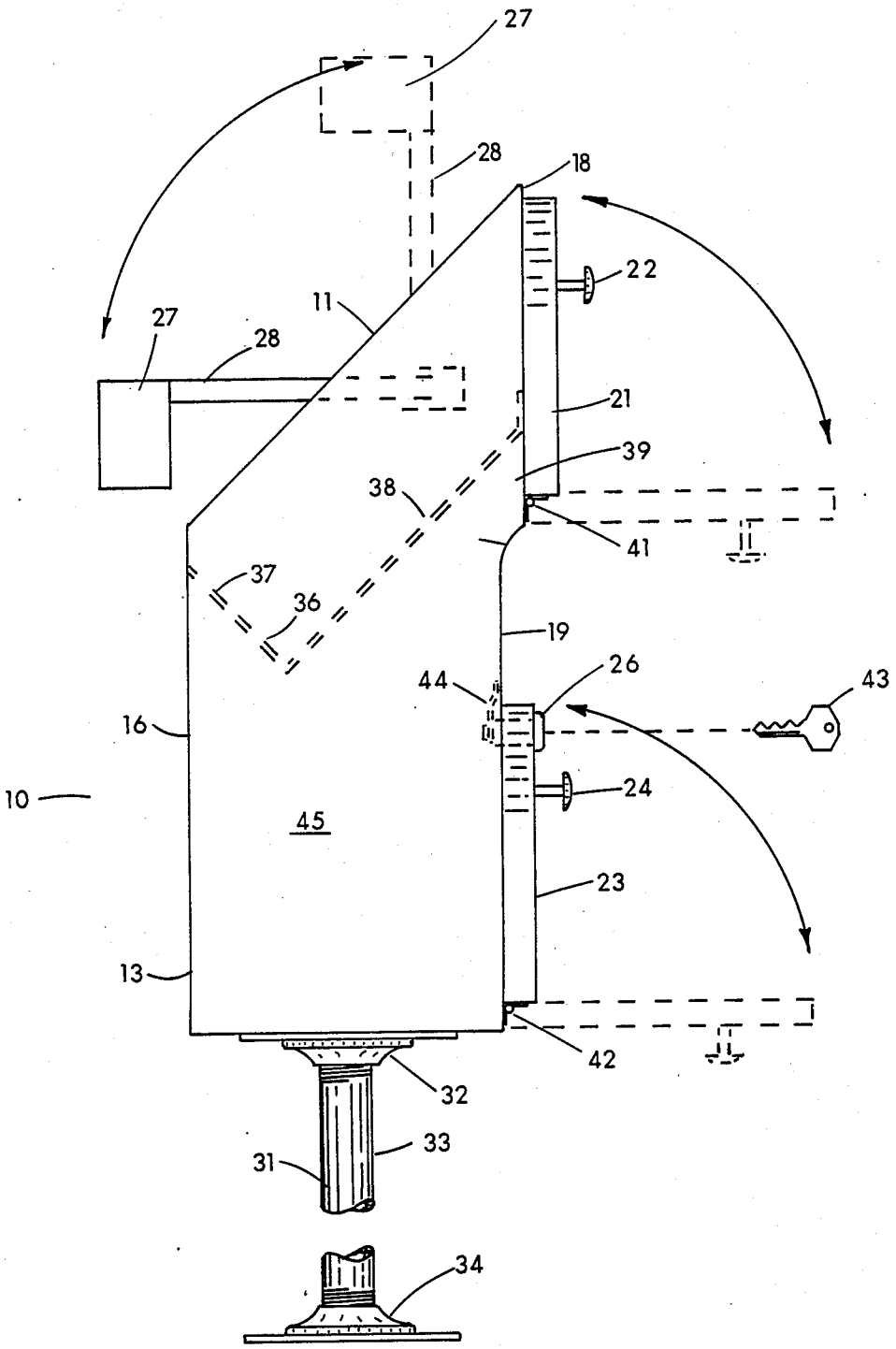
FIG. 2 is a side elevational view of the security mailbox.

With reference to FIG. 2 it can be seen that support post 31 is attached to support post base 32 which is attached to mailbox base 12. The upstanding support pole 31 can be made at any convenient length so that the mailbox can be set at a height that would allow for snow clearance and yet provide easy access from a vehicle to upper door 21 and lower door 23.

Continuing with reference to FIG. 2, it can be seen that interior tray 36 is provided for outgoing mail so that it can be retrieved from the postman through hinged door 21. In the convention manner of using mailboxes, flag 27 would be placed in an upright position when mail is inserted into tray 36.

Tray 36 is provided with backwall 37 and mail support lower wall 38 which is attached to back wall 16 and side walls 13 and 14 and upper front wall 18 in any conventional manner. Restricted mail introduction throat opening 39 is provided below tray lower base 38 so that mail can be introduced into mailbox 10 and yet throat opening 39 is small enough so that a thief or vandal cannot insert his hand through throat opening 39 to retrieve the mail. As was previously mentioned, upper door 21 is hinged and pivotally attached by hinge 41 to front wall 18 in a manner well known in the art. Similarly, lower door 23 is hinged to lower wall 19. A conventional lock 26 is provided with insertable key 43 and interior locking member 44 which is rotatable in a manner well known in the art so that locking member 44 rests against the interior of front wall 19 when the key is rotated in a locking position. When the key 43 is rotated to an unlocking position, locking member 44 is moved out of the hinged path of door 23 so that door 23 can be opened.

Doors 21 and 23 are provided to snuggly fit to upper walls 18 and 19 to provide a weather and wind resistant seal. Top surface 11 is slanted so that wind, rain, snow and the like do not adhere to the top of security mailbox 10.

As can be noted from reference to FIG. 2, upper door 21 is extended forwardly from lower door 23 to provide for throat opening 39 to allow introduction of the mail. It should also be noted that the curved throat portion 46 below throat opening 39 is provided for easy introduction of mail so that magazines, letters, and the like will not be stuck or lodged against front wall 19. Mail inserted through throat opening 39 thus falls into the interior 45 of security mailbox 10.

With reference to FIG. 3, it can be seen that security mailbox 10 provides a pleasing frontal appearance in that both doors 21 and 23 are curved on top.

With reference to FIG. 4, it can be seen that multiple mailboxes can be attached by inserting a threaded support members 54, 55, 56, and 53 into four-way support 58 and then additional upper support members 51 which correspond to support post 33 in FIG. 3 to provide for single mailboxes or any multiples of mailboxes to be supported by a single base support post 54.

It is contemplated that security mailbox 10 could be molded of opaque plastic or made of metal or a combination of plastic, wood, or metal; however, mailbox 10 could be transparent to view the contents as well.

Although specific applications, materials, components, connections, sequences of events, and methods have been stated in the above description of the preferred embodiment of the invention, other suitable materials, other applications, components and process steps as listed herein may be used with satisfactory results and varying degrees of quality. In addition, it will be understood that various other changes in details, materials, steps, arrangements of parts and uses which have been herein described and illustrated in order to explain the nature of the invention will occur to and may be made by those skilled in the art, upon a reading of this disclosure, and such changes are intended to be included within the principles and scope of this invention as hereinafter claimed.

We claim:

1. A security mailbox comprising:

a housing means having a horizontal base, a pair of opposed upstanding sidewalls, an upstanding back wall, a sloped top, an upstanding front wall wherein said upstanding front wall is provided with an upper and a lower opening, each of said openings having a lower edge;

a hinged door pivotally attached to said upper opening in said front wall;

a hinged door pivotally attached to said lower opening in said front wall;

a locking means attached to said lower door; and a mail tray attached to the interior of said housing wherein said mail tray is provided with a sloped base wherein said sloped base and said upper opening provide a throat opening for the introduction of mail wherein said throat opening is of a dimension less than the dimension necessary to allow the introduction of a human hand and arm through said throat opening.

2. The security mailbox as described in claim 1 wherein a portion of said throat opening is curved.

3. The security mailbox as described in claim 2 further comprising a pivotally attached flag, attached to one of said housing sidewalls.

4. The security mailbox as described in claim 3 wherein said hinged pivotal attachment of each of said upper and said lower doors is attached to said openings at the lower edge of said openings.

5. The security mailbox as described in claim 4 wherein said upper and said lower doors are tightly fitted to said housing to restrict water from being introduced into said security mailbox.

6. The security mailbox as described in claim 1 further comprising a base support attached to said housing base and adapted for attachment to the ground.

7. The security mailbox as described in claim 6 wherein said base support means is comprised of an elongate threaded pipe threadably attached to said housing base.

8. The security mailbox as described in claim 7 further comprising a threadably four-way fitting for attachment of additional support rods for the attachment of additional security mailboxes.

* * * * *